US005533558A

United States Patent [19]

Carey et al.

[11] Patent Number: 5,533,558

[45] Date of Patent: Jul. 9, 1996

[54] CREATIVE PURSE WITH INTERCHANGEABLE DECORATIVE COVERING

[76] Inventors: Sheri Carey; Thomas F. Carey, both of 375 Pine Needles La., Southern Pines, N.C. 28387-6910

[21] Appl. No.: 415,513

[22] Filed: Apr. 3, 1995

[51] Int. Cl.[6] ..... A45C 3/08; A45C 13/02; A45C 13/08

[52] U.S. Cl. ..... 150/105; 190/26; 383/111

[58] Field of Search ..... 150/103–105, 150/113; 190/26, 110; 383/111

[56] References Cited

U.S. PATENT DOCUMENTS

| | | | |
|---|---|---|---|
| 1,063,031 | 5/1913 | Henry | 150/105 |
| 1,414,866 | 5/1922 | Doersching | 150/105 |
| 1,960,396 | 5/1934 | Rosenberg | 150/105 |
| 2,019,693 | 11/1935 | Perl | 150/105 |
| 2,064,568 | 12/1936 | Sachs | 150/104 X |
| 2,131,382 | 9/1938 | Lobel | 150/105 |
| 2,369,482 | 2/1945 | Morris | 150/105 |
| 2,428,682 | 10/1947 | Rhodes | 150/104 |
| 2,572,683 | 12/1951 | Wachs | 150/104 |
| 2,711,203 | 6/1955 | Gerder | 150/104 |
| 2,723,696 | 11/1955 | Kase | 150/104 X |

FOREIGN PATENT DOCUMENTS

| | | | |
|---|---|---|---|
| 120166 | 12/1930 | Austria | 150/103 |
| 597563 | 5/1960 | Canada | 150/105 |
| 698329 | 1/1931 | France | 150/103 |
| 1108023 | 1/1936 | France | 150/105 |
| 663275 | 12/1951 | United Kingdom | 150/103 |
| 1089413 | 11/1967 | United Kingdom | 150/105 |

*Primary Examiner*—Sue A. Weaver
*Attorney, Agent, or Firm*—Michael I. Kroll

[57] ABSTRACT

A creative purse comprises a bag body with a separable decorative covering. A structure is for securing the separable decorative covering to the bag body in a releasable manner, so that the appearance of the bag body can be changed at will when the need arises.

6 Claims, 2 Drawing Sheets

CREATIVE PURSE WITH INTERCHANGEABLE DECORATIVE COVERING

BACKGROUND OF THE INVENTION

1. Field of the Invention

The instant invention relates generally to women's handbags and more specifically it relates to a creative purse.

2. Description of the Prior Art

Numerous women's handbags have been provided in prior art that are adapted to contain replaceable and interchangeable coverings. While these units may be suitable for the particular purpose to which they address, they would not be as suitable for the purposes of the present invention as heretofore described.

SUMMARY OF THE INVENTION

A primary object of the present invention is to provide a creative purse that will overcome the shortcomings of the prior art devices.

Another object is to provide a creative purse with a built-in structure that allows for a rapid and complete change of its outermost panel covering, so that unlimited changes of the outward panel fabric appearance can be accomplished.

An additional object is to provide a creative purse that will allow for a personal expression through unlimited choices of fabric coverings, rather than having a manufactured copy of one of thousands of similar purses.

A further object is to provide a creative purse that is simple and easy to use.

A still further object is to provide a creative purse that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
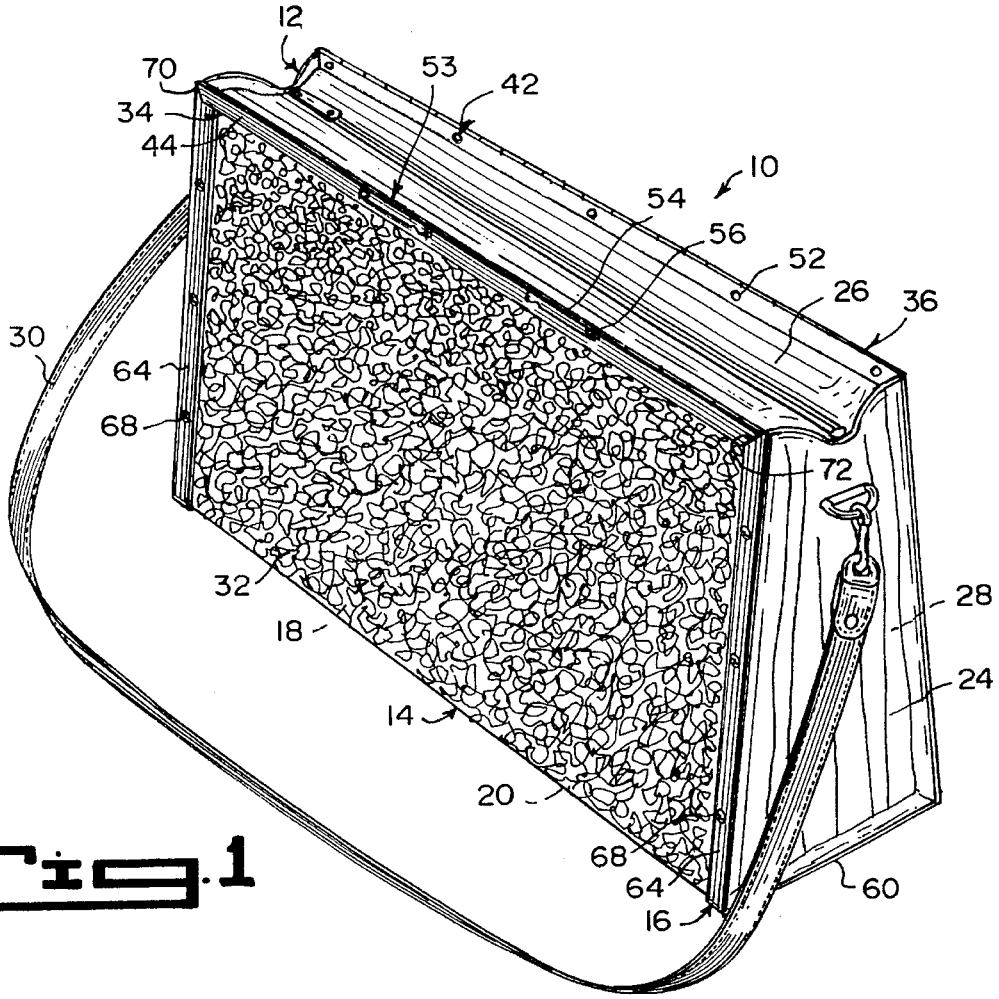
FIG. 1 is a perspective view of the instant invention with one type of fabric material covering installed thereto.

Turning now descriptively to the drawings, in which similar reference characters denote similar elements throughout the several views, FIGS. 1, 2, 3 and 5 illustrate a creative purse 10, comprising a bag body 12 with a separable decorative covering 14. A structure 16 is for securing the separable decorative covering 14 to the bag body 12 in a releasable manner, so that the appearance of the bag body 12 can be changed at will when the need arises.

The bag body 12 contains a front panel 18, a bottom panel 20, a rear panel 22, a pair of side gussets 24 and a top access panel 26. At least one compartment 28 is formed in the bag body 12 for storing small articles therein. A strap 30 is secured at both ends to the side gussets 24, so that a person can carry the bag body 12 by the strap 30. The separable decorative covering 14 is a one piece thin flexible sheet 32, sized and shaped to extend over and cover the front panel 18, the bottom panel 20 and the rear panel 22 of the bag body 12.

The securing structure 16 includes a first clamp member 34 that is spring biased closed. The first clamp member 34 extends at a full length across a top edge of the front panel 18 of the bag body 12, to retain a first end of the separable decorative covering 14 thereto. A second clamp member 36 is also spring biased closed. The second clamp member 36 extends at a full length across a top edge of the rear panel 22 of the bag body 12, to retain a second end of the separable decorative covering 14 thereto.

Figure 2:
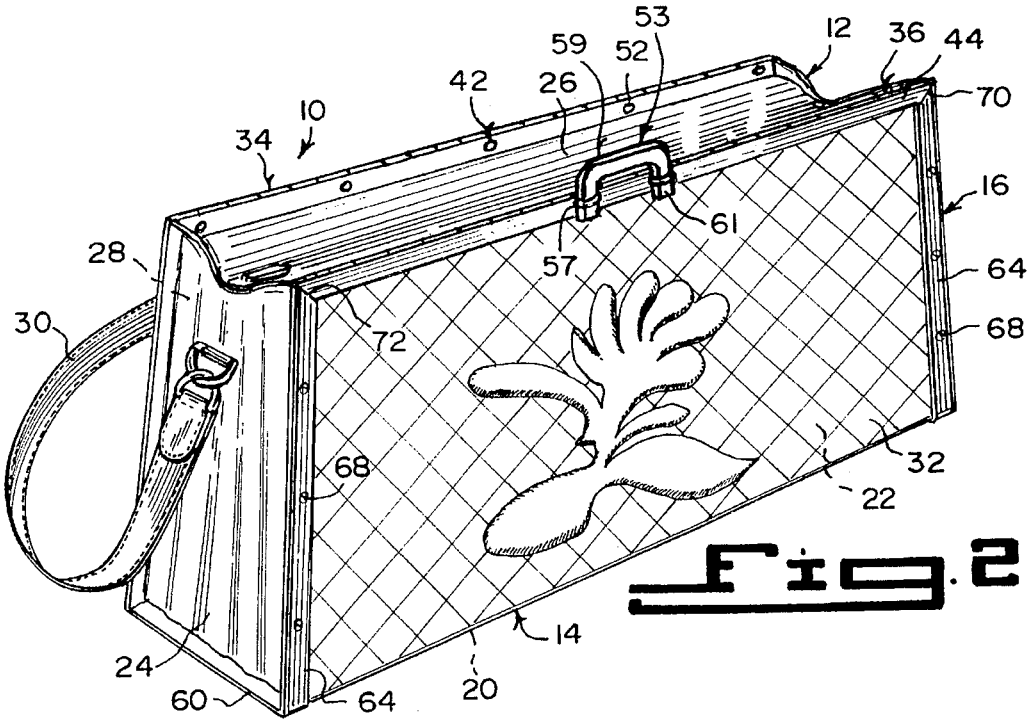
FIG. 2 is a perspective view of the instant invention with another type of fabric material covering installed thereto.
Figure 3:
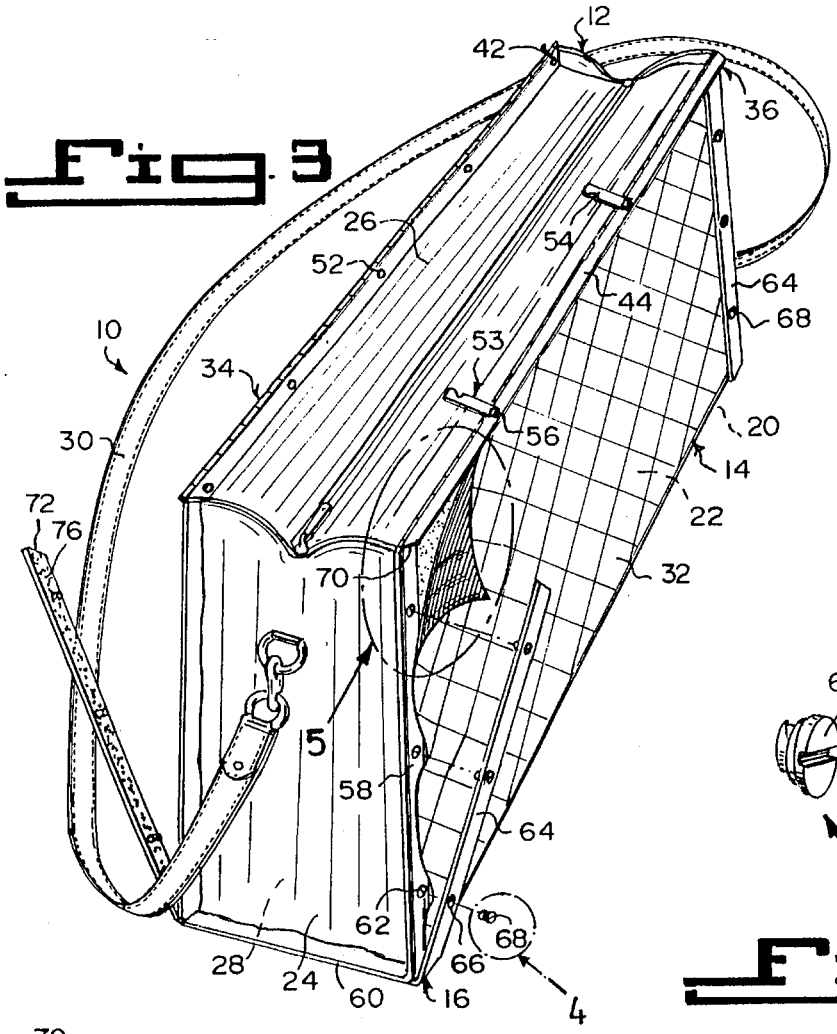
FIG. 3 is a perspective view similar to FIG. 2, with one end brace being disassembled therefrom.
Figure 5:
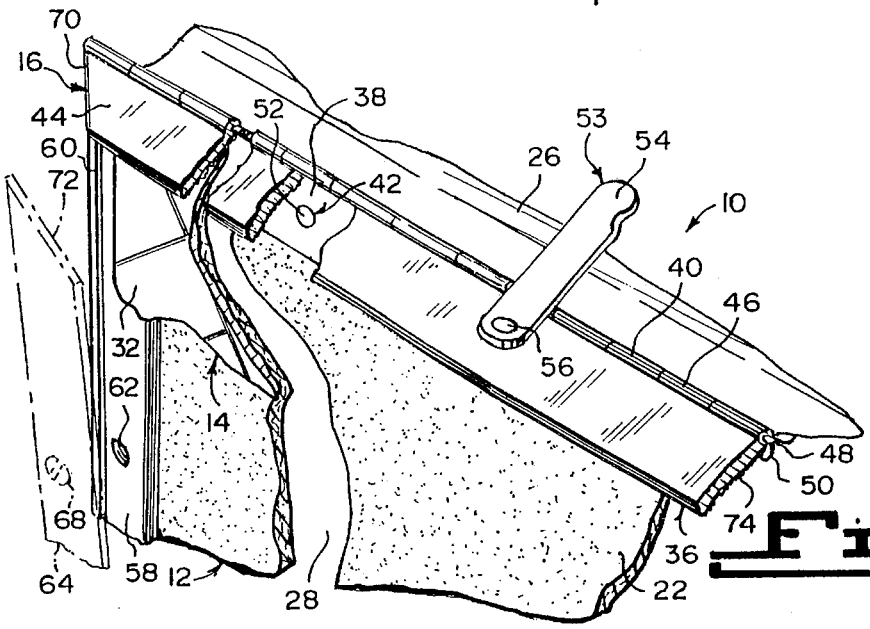
FIG. 5 is an enlarged perspective view, as indicated by arrow 5 in FIG. 3 with parts broken away, showing part of the second clamp member and one lever in greater detail.

The first clamp member 34 and the second clamp member 36 each consists of a first elongated leaf 38 having a first set of staggered barrels 40. Elements 42 are for affixing the first elongated leaf 38 adjacent a top edge of said front/rear panel 18/22 in a stationary manner. A second elongated leaf 44 has a second set of staggered barrels 46. An elongated pintle 48 extends through and interconnects the first set of staggered barrels 40 with the second set of staggered barrels 46, so that the second elongated leaf 44 can pivot thereon. A spring 50 is located on the pintle 48 to normally keep the second elongated leaf 46 down in a closed position. The affixing elements 42 are a plurality of rivets 52 spaced apart and extending through the first elongated leaf 38 and into the front/rear panel 18/22 adjacent the top edge thereof. Equipment 53 is for facilitating the lifting of the second elongated leaf 44 into an open position. The lifting equipment 53, as shown in FIGS. 1, 3 and 5, is at least one lever 54 pivotally mounted at 56 on the second elongated leaf 44. The at least one lever 54 can be pivoted up at a right angle and pressed back towards the top access panel 26, so that the second elongated leaf 44 will go into the open position. The lifting equipment 53, as shown in FIG. 2, consists of the second elongated leaf 44 having a pair of spaced apart raised loops 57. A C-shaped tool 59 has a pair of arms 61, which fit into the raised loops 57. The tool 59 can be pressed backwardly towards the top access panel 26, so that the second elongated leaf 44 will go into the open position.

Figure 4:
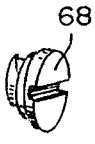
FIG. 4 is an enlarged perspective view, as indicated by arrow 4 in FIG. 3, showing one of the aircraft type fasteners in greater detail.

The releasable securing structure 16 further includes a pair of U-shaped frames 58. Each frame 58 has an outer rib 60, a plurality of spaced apart threaded holes 62 and is permanently attached to the side edges of the bag body 12, so that the outer rib 60 extends about the side gusset 24. A pair of U-shaped end braces 64 are provided. Each end brace 64 has a plurality of spaced apart apertures 66 that line up with said threaded holes 62 in the matching frame 58. A plurality of aircraft type fasteners 68, as best seen in FIG. 4, are utilized. Each fastener 68 is carried in a rotatively retained position by an inside washer or pin flush in one aperture 66 in the end braces 64. The end braces 64 can be clamped to the frames 58 and against the outer ribs 60 by the fasteners 68 engaging into the threaded holes 62, thereby to retain side edges of the separable decorative covering 14 between the frames 58 and the end braces 64.

The second elongated leaf 44 of the first clamp member 34 and the second clamp member 36, have opposite beveled ends 70. The end braces 64, have opposite beveled ends 72. When the second elongated leaf 44 of the first clamp member 34 and the second clamp member 36 are in the closed position, a molding effect will be provided for a good finish appearance. The second elongated leaf 44 of the first clamp member 34 and the second clamp member 36, all have a serrated inner surface 74, to better grip into the ends of the separable decorative covering 14. The end braces 64 have a serrated inner surface 76, to better grip into the side edges of the separable decorative covering 14.

LIST OF REFERENCE NUMBERS

10—creative purse
12—bag body
14—separable decorative covering on 12
16—releasable securing structure for 14
18—front panel of 12
20—bottom panel of 12
22—rear panel of 12
24—side gusset of 12
26—top access panel of 12
28—compartment in 12
30—strap
32—one piece thin flexible sheet for 14
34—first clamp member
36—second clamp member
38—first elongated leaf of 34 and 36
40—barrel on 38
42—affixing element
44—second elongated leaf of 34 and 36
46—barrel on 44
48—elongated pintle
50—spring on 48
52—rivet for 42
53—lifting equipment
54—lever
56—pivot mount of 54
57—raised loop on 44
58—U-shaped frame
59—C-shaped tool
60—outer rib on 58
61—arm of 59
62—threaded hole in 58
64—U-shaped end brace
66—aperture in 64
68—aircraft type fastener
70—beveled end of 44
72—beveled end of 64
74—serrated inner surface of 44
76—serrated inner surface of 64

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A creative purse comprising:

a) a bag body comprising a front panel, a bottom panel, a rear panel, a pair of side gussets, and a top access panel forming at least one compartment in said bag body for storing small articles therein;

b) a separable decorative covering comprising a one piece thin flexible sheet sized and shaped to extend over and cover said front panel, said bottom panel, and said rear panel of said bag body;

c) means for securing said separable decorative covering to said bag body in a releasable manner, so that the appearance of said bag body can be changed at will when the need arises, said securing means including a first clamp member extending the full length across a top edge of said front panel of said bag body spring biased closed to retain a first end of said separable decorative covering and a second clamp member extending the full length across a top edge of said rear panel of said bag body spring biased to retain a second end of said separable decorative covering thereto; and d) said first and second clamp members each including a first elongated leaf having a first set of staggered barrels, means for affixing said first elongated leaf a adjacent a top edge of said front/rear panel in a stationary manner, a second elongated leaf having a second set of staggered barrels, an elongated pintle extending through and interconnecting said first set of staggered barrels with said second set of staggered barrels, so that said second elongated leaf can pivot thereon, and spring located on said pintle to normally keep said second elongated leaf down in a closed position clamping the first and second ends of said decorative covering between the first and second elongated leafs of said first and second clamp members, respectively.

2. A creative purse as recited in claim 1, wherein said bag body further includes a strap secured at both ends to said side gussets, so that a person can carry said bag body by said strap.

3. A creative purse as recited in claim 1, wherein said affixing means includes a plurality of rivets spaced apart and extending through said first elongated leaf and into said front/rear panel adjacent said top edge thereof.

4. A creative purse as recited in claim 3, further including means for facilitating the lifting of said second elongated leaf into an open position.

5. A creative purse as recited in claim 4, wherein said facilitating means includes at least one lever pivotally mounted on said second elongated leaf, said at least one lever can be pivoted up at a right angle and pressed backwardly towards said top access panel, so that said second elongated leaf will go into the open position.

6. A creative purse as recited in claim 5, wherein said second elongated leaf of said first clamp member and said second clamp member have a serrated inner surface to better grip into the ends of said separable decorative covering.

* * * * *